US010779569B2

(12) United States Patent
Roudier et al.

(10) Patent No.: US 10,779,569 B2
(45) Date of Patent: Sep. 22, 2020

(54) INSULATED HEAT SOURCE

(71) Applicant: Philip Morris Products S.A., Neuchatel (CH)

(72) Inventors: Stephane Roudier, Colombier (CH); Samuel Bonnely, Cormondreche (CH)

(73) Assignee: Philip Morris Products S.A., Neuchatel (CH)

( * ) Notice: Subject to any disclaimer, the term of this patent is extended or adjusted under 35 U.S.C. 154(b) by 266 days.

(21) Appl. No.: 14/424,731

(22) PCT Filed: Aug. 29, 2013

(86) PCT No.: PCT/EP2013/067871

§ 371 (c)(1),
(2) Date: Feb. 27, 2015

(87) PCT Pub. No.: WO2014/037270

PCT Pub. Date: Mar. 13, 2014

(65) Prior Publication Data

US 2015/0216231 A1 Aug. 6, 2015

(30) Foreign Application Priority Data

Sep. 4, 2012 (EP) ..... 12182972

(51) Int. Cl.
*A24F 47/00* (2020.01)
*A24D 1/22* (2020.01)

(52) U.S. Cl.
CPC ..... *A24F 47/006* (2013.01); *A24D 1/22* (2020.01)

(58) Field of Classification Search
CPC ..... A24F 47/002; A24F 47/004; A24F 47/006
See application file for complete search history.

(56) References Cited

U.S. PATENT DOCUMENTS 3,714,047 A * 1/1973 Marion ..... C04B 26/02 102/290
3,994,895 A * 11/1976 Wasserman ..... C10M 7/00 508/130

(Continued)

FOREIGN PATENT DOCUMENTS

CN 86 1 05536 A 2/1987
CN 1059565 A 3/1992

(Continued)

OTHER PUBLICATIONS

Combined Chinese Office Action and Search Report dated Oct. 26, 2016 in Patent Application No. 201380046055.X (with English translation).

(Continued)

*Primary Examiner* — Eric Yaary
(74) *Attorney, Agent, or Firm* — Oblon, McClelland, Maier & Neustadt, L.L.P.

(57) ABSTRACT

There is provided a heat source for a smoking article, including an upstream end and an opposed downstream end, and further including a combustible carbonaceous core and an integral, non-combustible, thermally insulating, peripheral layer. The core extends from the upstream end of the heat source the downstream end of the heat source. The peripheral layer extends from the upstream end of the heat source only part way along the length of the heat source and circumscribes an upstream portion of the core.

21 Claims, 2 Drawing Sheets

(56) References Cited

U.S. PATENT DOCUMENTS

| | | | | | |
|---|---|---|---|---|---|
| 4,535,002 | A * | 8/1985 | Kirkhuff | C04B 26/02 | 156/276 |
| 4,714,082 | A | 12/1987 | Banerjee et al. | | |
| 4,756,318 | A * | 7/1988 | Clearman | A24F 47/004 | 131/196 |
| 4,771,795 | A * | 9/1988 | White | A24F 47/004 | 131/194 |
| 4,819,665 | A * | 4/1989 | Roberts | A24F 47/004 | 131/194 |
| 4,892,783 | A * | 1/1990 | Brazel | B32B 18/00 | 442/326 |
| 5,027,836 | A | 7/1991 | Shannon et al. | | |
| 5,040,551 | A | 8/1991 | Schlatter et al. | | |
| 5,076,297 | A | 12/1991 | Farrier et al. | | |
| 5,095,921 | A | 3/1992 | Losee et al. | | |
| 5,129,409 | A * | 7/1992 | White | A24F 47/004 | 131/360 |
| 2007/0215168 | A1 | 9/2007 | Banerjee et al. | | |
| 2009/0065011 | A1* | 3/2009 | Maeder | A24F 47/006 | 131/194 |
| 2011/0036367 | A1 | 2/2011 | Saito et al. | | |
| 2011/0271971 | A1 | 11/2011 | Conner et al. | | |
| 2012/0042885 | A1* | 2/2012 | Stone | A24B 15/165 | 131/194 |
| 2012/0305012 | A1* | 12/2012 | Dyakonov | A24D 1/025 | 131/284 |
| 2013/0276803 | A1 | 10/2013 | Saito et al. | | |

FOREIGN PATENT DOCUMENTS

| | | | | |
|---|---|---|---|---|
| CN | 1248888 | A | 3/2000 | |
| CN | 1607911 | A | 4/2005 | |
| CN | 102481021 | A | 5/2012 | |
| EP | 0 354 661 | A2 | 2/1990 | |
| EP | 0 494 784 | A3 | 7/1992 | |
| EP | 0 535 695 | A3 | 4/1993 | |
| EP | 1 670 326 | B1 | 2/2007 | |
| EP | 2 289 357 | | 3/2011 | |
| JP | S63-192372 | A | 8/1988 | |
| JP | 7-330403 | A | 12/1995 | |
| JP | 2010-535530 | A | 11/2010 | |
| RU | 110 608 | U1 | 11/2011 | |
| UA | 92474 | C2 | 11/2010 | |
| UA | 67598 | U | 2/2012 | |
| WO | WO 2009/022232 | A2 | 2/2009 | |
| WO | WO-2011117750 | A2 * | 9/2011 | A24B 15/165 |
| WO | WO 2013/043299 | A2 | 3/2013 | |
| WO | WO 2013/098380 | A1 | 7/2013 | |

OTHER PUBLICATIONS

International Search Report dated Feb. 17, 2014 in PCT/EP13/067871 Filed Aug. 29, 2013.

Written Opinion of the International Searching Authority dated Feb. 17, 2014 in PCT/EP13/067871 Filed Aug. 29, 2013.

Office Action dated Jul. 10, 2017 in Japanese Patent Application No. 2015-530350 (with English translation).

Decision on Grant dated Jul. 19, 2017 in Russian Patent Application No. 2015112304 (with partial English translation).

Japanese Office Action with English translation dated Jun. 6, 2018 in corresponding Japanese Patent Application No. 2015-530350, citing document AO therein (17 pages).

* cited by examiner

INSULATED HEAT SOURCE

CROSS REFERENCE TO RELATED APPLICATION

This application is a U.S. national phase application under 35 U.S.C. § 371 of PCT/EP2013/067871, filed on Aug. 29, 2013, and claims the benefit of priority under 35 U.S.C. § 119 from prior EP Application No. 12182972.5, filed on Sep. 4, 2012, the entire contents of each of which are incorporated herein by reference.

The present invention relates to an insulated heat source for a smoking article and to a smoking article comprising an insulated heat source.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

It is known to include a heat-conducting element around and in contact with at least a rear portion of the combustible heat source and at least a front portion of the aerosol-forming substrate of the heated smoking article in order to ensure sufficient conductive heat transfer from the combustible heat source to the aerosol-forming substrate to obtain an acceptable aerosol. For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate.

The combustion temperature of a combustible heat source for use in a heated smoking article should not be so high as to result in combustion or thermal degradation of the aerosol forming material during use of the heated smoking article. However, the combustion temperature of the combustible heat source should be sufficiently high to generate enough heat to release sufficient volatile compounds from the aerosol forming material to produce an acceptable aerosol, especially during early puffs.

A variety of combustible carbon-containing heat sources for use in heated smoking articles have been proposed in the art. The combustion temperature of combustible carbon-containing heat sources for use in heated smoking articles is typically between about 600° C. and 800° C. Heated smoking articles comprising combustible carbon-containing heat sources can have an undesirably high ignition propensity due to the high combustion temperature of combustible carbon-containing heat sources.

It is known to wrap an insulating member around the periphery of a combustible carbon-containing heat source of a heated smoking article in order to reduce the ignition propensity of the heated smoking article. Inclusion of an insulating member circumscribing the combustible carbon-containing heat source of a heated smoking article reduces the ignition propensity of the heated smoking article by reducing the surface temperature of the heated smoking article.

For example, U.S. Pat. No. 4,714,082 discloses a smoking article comprising a combustible carbon-containing fuel element, an aerosol generating means, a heat-conducting member and a peripheral insulating member of resilient, non-burning material, such as a jacket of glass fibers. The insulating member circumscribes at least part of the fuel element and advantageously at least part of the aerosol generating means.

Inclusion of a non-integral insulating member as disclosed in U.S. Pat. No. 4,714,082 may result in a heated smoking article having a transverse cross-section that is not constant along the length of the smoking article. This may adversely affect the appearance of the heated smoking article and make it more difficult to secure reliably the combustible carbon-containing heat source within the heated smoking article. Inclusion of a non-integral insulating member may also add to the complexity of assembly of the heated smoking article.

It would be desirable to provide an insulated heat source for a smoking article that has a reduced ignition propensity, acceptable appearance, and that may be assembled in a reliable manner.

It would also be desirable to provide an insulated heat source for a smoking article that has a reduced ignition propensity and that provides an acceptable aerosol during both early puffs and late puffs.

According to the invention there is provided a heat source for a smoking article having an upstream end and an opposed downstream end, the heat source comprising: a combustible carbonaceous core; and an integral, non-combustible, thermally insulating, peripheral layer. The core extends from the upstream end of the heat source to the downstream end of the heat source. The peripheral layer extends from the upstream end of the heat source only part way along the length of the heat source and surrounds an upstream portion of the core.

According to the invention there is also provided a smoking article comprising a heat source according to the invention; an aerosol-forming substrate downstream of the heat source; and a heat-conducting, combustion-resistant wrapper around and in direct contact with an upstream portion of the aerosol-forming substrate and a downstream portion of the core of the heat source.

As used herein, the terms 'upstream' and 'front', and 'downstream' and 'rear', are used to describe the relative positions of components, or portions of components, of smoking articles according to invention in relation to the direction in which a user draws on the smoking article during use thereof. Smoking articles according to the invention comprise a mouth end and an opposed distal end. In use, a user draws on the mouth end of the smoking article. The mouth end is downstream of the distal end. The heat source is located at or proximate to the distal end of the smoking article.

As used herein, the term 'carbonaceous' is used to describe a core or layer comprising carbon.

As used herein the term 'integral' is used to describe a layer that is in direct contact with the core and attached to the core without the aid of an extrinsic adhesive or other intermediate connecting material.

As used herein, the term 'extrinsic adhesive' is used to describe an adhesive that is not a component of the core or peripheral layer.

As used herein the term 'non-combustible' is used to describe a layer, barrier or material that is substantially non-combustible at temperatures reached by the heat source during combustion or ignition of the combustible carbonaceous core.

The non-combustible, thermally insulating, peripheral layer should be stable at temperatures to which it is subjected during ignition and combustion of the core and should remain substantially intact during ignition and combustion of the core.

As used herein the term 'peripheral layer' is used to describe an outermost layer of heat sources according to the invention.

As used herein the term 'thermally insulating layer' is used to describe a layer comprising thermally insulating material.

As used herein the term 'thermally insulating material' is used to describe material having a bulk thermal conductivity of less than about 50 milliwatts per metre Kelvin (mW/(m·K)) at 23° C. and a relative humidity of 50% as measured using the modified transient plane source (MTPS) method.

Preferably, the non-combustible, thermally insulating, peripheral layer comprises thermally insulating material having a bulk thermal diffusivity of less than or equal to about 0.01 square centimetres per second ($cm^2/s$) as measured using the laser flash method.

Preferably, in use in smoking articles according to the invention, the outer surface of the non-combustible, thermally insulating, peripheral layer should not exceed about 350° C.

The air permeability of the thermally insulating, peripheral layer should be sufficient to allow enough oxygen to reach the combustible carbonaceous core to sustain combustion thereof.

As used herein, the term 'length' is used to describe the maximum longitudinal dimension of heat sources and smoking articles according to the invention between the upstream end and the downstream end thereof.

As used herein, the term 'aerosol-forming substrate' is used to describe a substrate capable of releasing upon heating volatile compounds, which can form an aerosol.

As used herein, the term 'heat-conducting' is used to describe a wrapper formed from material having a bulk thermal conductivity of at least about 10 W per metre Kelvin (W/(m·K)) at 23° C. and a relative humidity of 50% as measured using the modified transient plane source (MTPS) method. In certain embodiments, the heat-conducting, combustion-resistant wrapper is preferably formed from a material having a bulk thermal conductivity of at least about 100 W per metre Kelvin (W/(m·K)), more preferably of at least about 200 W per metre Kelvin (W/(m·K)), at 23° C. and a relative humidity of 50% as measured using the modified transient plane source (MTPS) method.

As used herein, the term 'combustion-resistant' is used to describe a wrapper that remains substantially intact during ignition and combustion of the core.

The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

Inclusion of an integral, non-combustible, thermally insulating, peripheral layer advantageously helps to reduce the ignition propensity of smoking articles comprising heat sources according to the invention by reducing the temperature of the surface of the smoking article.

The combustible carbonaceous core extends along the length of the heat source from the upstream end of the heat source to the downstream end of the heat source. The integral, non-combustible, thermally insulating, peripheral layer extends from the upstream end of the heat source only part way along the length of the heat source and circumscribes an upstream portion of the combustible carbonaceous core.

In use in smoking articles according to the invention, heat generated during combustion of the core of the heat source is transferred by conduction to the aerosol-generating substrate downstream of the heat source via the heat-conducting, combustion-resistant wrapper. The reduced length of the peripheral layer compared to the core allows the heat-conducting, combustion-resistant wrapper to be in direct contact with a downstream portion of the combustible carbonaceous core of the heat source that is not circumscribed by the peripheral layer. This advantageously helps to achieve sufficiently high conductive heat transfer from the heat source to the aerosol-generating substrate to produce an acceptable aerosol.

Heat sources according to the invention may be produced having different shapes and dimensions depending upon their intended use.

Heat sources according to the invention may have a mass of between about 300 mg and about 500 mg, for example a mass of between about 400 mg and about 450 mg.

Preferably, heat sources according to the invention are substantially cylindrical. In such embodiments, the term 'peripheral layer' is used to describe a radially outermost annular layer of heat sources according to the invention.

Cylindrical heat sources according to the invention may be of substantially circular cross-section or substantially elliptical cross-section.

Preferably, heat sources according to the invention have a length of between about 5 mm and about 20 mm, more preferably of between about 7 mm and about 15 mm, most preferably of between about 11 mm and about 13 mm.

Preferably, heat sources according to the invention are of substantially constant diameter. As used herein, the term 'diameter' is used to describe the maximum transverse dimension of heat sources according to the invention.

In such embodiments, the diameter of the upstream portion of the core circumscribed by the peripheral layer is less than the diameter of the portion of the core that is not circumscribed by the peripheral layer. The difference in diameter is approximately equal to twice the thickness of the peripheral layer.

As used herein, the term 'thickness' is used to describe the maximum transverse dimension of layers of heat sources according to the invention.

Preferably, heat sources according to the invention have a diameter of between about 5 mm and about 10 mm, more preferably of between about 7 mm and about 8 mm.

Preferably, the length of the peripheral layer is at least about 2 mm less than the length of the heat source, more preferably at least about 3 mm less than the length of the heat source. The difference in length between the peripheral layer and the heat source is equal to the length of the portion of the core that is not circumscribed by the heat source.

Preferably, the peripheral layer has a length of between about 3 mm and about 18 mm, more preferably of between about 4 mm and about 12 mm, most preferably of between about 7 mm and about 9 mm.

Preferably, the peripheral layer has a thickness of less than or equal to about 1.5 mm. More preferably, the peripheral layer has a thickness of between about 0.5 mm and about 1.5 mm.

Heat sources according to the invention comprise a combustible carbonaceous core containing carbon as a fuel.

The carbon content of the core may be at least about 5 percent by dry weight. For example, the carbon content of the core may be at least about 10 percent, at least about 20 percent, at least about 30 percent or at least 40 percent by dry weight.

Preferably, the core has a carbon content of at least about 35 percent, more preferably of at least about 40 percent, most preferably of at least about 45 percent by dry weight.

In certain embodiments, heat sources according to the invention may comprise a combustible carbon-based core.

As used herein, the term 'carbon-based' is used to describe a core comprised primarily of carbon. That is a core having a carbon content of at least 50 percent.

For example, heat sources according to the invention may comprise combustible carbon-based cores having a carbon content of at least about 60 percent, at least about 70 percent, or at least about 80 percent by dry weight.

The core of heat sources according to the invention may be formed from one or more suitable carbon-containing materials. Suitable carbon-containing materials are well known in the art and include, but are not limited to, carbon powder.

Preferably, the core further comprises at least one ignition aid.

As used herein, the term 'ignition aid' is used to describe a material that releases one or both of energy and oxygen during ignition of the core, where the rate of release of one or both of energy and oxygen by the material is not ambient oxygen diffusion limited. In other words, the rate of release of one or both of energy and oxygen by the material during ignition of the core is largely independent of the rate at which ambient oxygen can reach the material. As used herein, the term 'ignition aid' also is used to describe an elemental metal that releases energy during ignition of the core, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion.

In use the release of one or both of energy and oxygen by the at least one ignition aid during ignition of the core results in a boost in temperature of the core upon ignition thereof. This is reflected in an increase in temperature of the heat source. In use in a smoking article according to the invention, this advantageously ensures that sufficient heat is available to be transferred from the heat source to the aerosol-forming substrate of the smoking article and so facilitates production of an acceptable aerosol during early puffs thereof.

Preferably, the at least one ignition aid is present in an amount of at least about 20 percent by dry weight of the core.

It will be appreciated that the amount of at least one ignition aid that must be included in the core of a heat source according to the invention in order to achieve a sufficient boost in temperature will vary depending on the specific at least one ignition aid included in the core.

In general, the greater the quantity of one or both of energy and oxygen released by the at least one ignition aid per unit mass thereof, the lower the amount of the at least one ignition aid that must be included in the core of a heat source according to the invention.

In some embodiments, the at least one ignition aid is preferably present in an amount of at least about 25 percent, more preferably at least about 30 percent, most preferably at least about 40 percent by dry weight of the core.

Preferably, the at least on ignition aid is present in an amount of less than about 65 percent by dry weight of the core.

In some embodiments, the at least one ignition aid is preferably present in an amount of at less than about 60 percent, more preferably less than about 55 by dry weight of the core, most preferably less than about 50 by dry weight of the core.

Suitable ignition aids for use in the core of heat sources according to the invention are known in the art.

The core may comprise one or more ignition aids consisting of a single element or compound that release energy upon ignition of the core. The release of energy by the one or more ignition aids upon ignition of the core directly causes a 'boost' in temperature during an initial stage of combustion of the core.

For example, in certain embodiments the core may comprise one or more energetic materials consisting of a single element or compound that reacts exothermically with oxygen upon ignition of the core. Examples of suitable energetic materials include, but are not limited to, aluminium, iron, magnesium and zirconium.

Alternatively or in addition, the core may comprise one or more ignition aids comprising two or more elements or compounds that react with one another to release energy upon ignition of the core.

For example, in certain embodiments the core may comprise one or more thermites or thermite composites comprising a reducing agent such as, for example, a metal, and an oxidizing agent such as, for example, a metal oxide, that react with one another to release energy upon ignition of the core. Examples of suitable metals include, but are not limited to, magnesium, and examples of suitable metal oxides include, but are not limited to, iron oxide ($Fe_2O_3$) and aluminium oxide ($Al_2O_3$)

In other embodiments, the core may comprise one or more ignition aids comprising other materials that undergo exothermic reactions upon ignition of the core. Examples of suitable metals include, but are not limited to, intermetallic and bi-metallic materials, metal carbides and metal hydrides.

Preferably, the core comprises at least one ignition aid that releases oxygen during ignition of the core. In such embodiments, the release of oxygen by the at least one ignition aid upon ignition of the core indirectly results in a 'boost' in temperature during an initial stage of combustion of the core by increasing the rate of combustion of the core. This is reflected in the temperature profile of the heat source.

For example, the core may comprise one or more oxidizing agents that decompose to release oxygen upon ignition of the core. The core may comprise organic oxidizing agents, inorganic oxidizing agents or a combination thereof. Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; carbonates; iodates; periodates; iodites; sulphates; sulfites; other sulfoxides; phosphates; phospinates; phosphites; and phosphanites.

The core of heat sources according to the invention may comprise one or more ignition aids consisting of a single element or compound that release oxygen upon ignition of the core. Alternatively or in addition, the core of heat sources according to the invention may comprise one or more ignition aids comprising two or more elements or compounds that react with one another to release oxygen upon ignition of the core.

The core may comprise one or more ignition aids that release both energy and oxygen upon ignition of the core. For example, the core may comprise one or more oxidizing agents that decompose exothermically to release oxygen upon ignition of the core.

Alternatively, or in addition, the core may comprise one or more first ignition aids that release energy upon ignition of core and one or more second ignition aids, which are different from the one or more first ignition aids, that release oxygen upon ignition of the core.

In certain embodiments, the core may comprise at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In such embodiments, when the core is exposed to a conventional yellow flame lighter or other ignition means, the at least one metal nitrate salt decomposes to release oxygen and energy. This causes an initial boost in the temperature of the heat source and also aids in the ignition of the core. Following total decomposition of the at least one metal nitrate salt, the core continues to combust at a lower temperature.

The inclusion of at least one metal nitrate salt advantageously results in ignition of the core being initiated internally, and not only at a point on the surface thereof.

Preferably, the at least one metal nitrate salt is selected from the group consisting of potassium nitrate, sodium nitrate, calcium nitrate, strontium nitrate, barium nitrate, lithium nitrate, aluminium nitrate, iron nitrate and combinations thereof.

In certain embodiments, the core may comprise at least two different metal nitrate salts. In one embodiment, the core comprises potassium nitrate, calcium nitrate and strontium nitrate.

In certain preferred embodiments, the core comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably of between about 200° C. and about 400° C., most preferably at a temperature of about 350° C.

In such embodiments, when the core is exposed to a conventional yellow flame lighter or other ignition means, the at least one peroxide or superoxide decomposes to release oxygen. This causes an initial boost in the temperature of the core and also aids in the ignition of the core. Following total decomposition of the at least one peroxide or superoxide, the core continues to combust at a lower temperature.

The inclusion of at least one peroxide or superoxide advantageously results in ignition of the core being initiated internally, and not only at a point on the surface thereof.

Examples of suitable peroxides and superoxides include, but are not limited to: strontium peroxide; magnesium peroxide; barium peroxide, lithium peroxide; zinc peroxide; potassium superoxide; and sodium superoxide.

Preferably, the at least one peroxide is selected from the group consisting of calcium peroxide, strontium peroxide, magnesium peroxide, barium peroxide and combinations thereof.

Alternatively or in addition to the at least one ignition aid, the core may comprise one or more other additives to improve the properties of the heat source. Suitable additives include, but are not limited to, additives to promote consolidation of the heat source (for example, sintering aids, such as calcium carbonate), additives to promote combustion of the combustible core (for example, potassium and alkali metal burn salts, for example potassium salts such as potassium chloride and potassium citrate) and additives to promote decomposition of one or more gases produced by combustion of the core, for example catalysts, such as copper oxide (CuO), iron oxide ($Fe_2O_3$), iron oxide silicate powder and aluminium oxide ($Al_2O_3$).

The composition of the upstream portion of the combustible carbonaceous core of heat sources according to the invention that is surrounded by the peripheral layer may be substantially the same as the composition of the downstream portion of the core that is not circumscribed by the peripheral layer.

Alternatively, the composition of the upstream portion of the combustible carbonaceous core of heat sources according to the invention that is surrounded by the peripheral layer may be different from the composition of the downstream portion of the core of that is not circumscribed by the peripheral layer.

The combustible carbonaceous core of heat sources according to the invention may comprise two or more layers of different composition.

In certain preferred embodiments, the core comprises a first layer comprising carbon and a second layer comprising at least one ignition aid, wherein the composition of the first layer is different from the composition of the second layer.

The inclusion in the core of heat sources according to the invention of a first layer comprising carbon and a second layer comprising at least one ignition aid allows different temperature profiles to be provided during early puffs and late puffs of smoking articles according to the invention. This advantageously facilitates production of an acceptable aerosol by smoking articles according to the invention during both early puffs and late puffs.

Flaming and sparkling can be associated with the use of certain ignition aids and other additives in heat sources for smoking articles. The inclusion in the core of heat sources according to the invention of a first layer comprising carbon and a second layer comprising at least one ignition aid advantageously allows such additives to be located in a position within the core of the heat source where one or both of the occurrence and visibility of flaming and sparkling is eliminated or reduced.

In certain preferred embodiments, the first layer comprises carbon and at least one ignition aid and the second layer comprises carbon and at least one ignition aid, wherein the ratio by dry weight of carbon to ignition aid in the first layer is different from the ratio by dry weight of carbon to ignition aid in the second layer.

In certain particularly preferred embodiments, the combustible first layer comprises carbon and at least one peroxide and the second layer comprises carbon and at least one peroxide, wherein the ratio by dry weight of carbon to peroxide in the combustible first layer is different from the ratio by dry weight of carbon to peroxide in the second layer.

In one particularly preferred embodiment, the combustible first layer comprises carbon and calcium peroxide and the second layer comprises carbon and calcium peroxide, wherein the ratio by dry weight of carbon to calcium peroxide in the combustible first layer is different from the ratio by dry weight of carbon to calcium peroxide in the second layer.

In embodiments where both the first layer and the second layer comprise at least one ignition aid, the ignition aid content of the second layer is preferably greater than the ignition aid content of the first layer.

In embodiments where both the first layer and the second layer comprise at least one ignition aid, the at least one ignition aid in first layer may be the same as or different from the at least one ignition aid in the second layer.

The first layer and the second layer may be longitudinal layers.

As used herein, the term 'longitudinal' is used to describe layers than meet along an interface that extends along the length of the core of the heat source.

In certain embodiments, the first layer and the second layer may be concentric longitudinal layers. In other embodiments, the first layer and the second may be non-concentric longitudinal layers.

In certain preferred embodiments, the first layer may be an outer longitudinal layer and the second layer may be an inner longitudinal layer, which is circumscribed by the first layer. In such embodiments, the second layer may advantageously act as a 'fuse' upon ignition of the core of the heat source. In addition in such embodiments, one or both of the occurrence and visibility of flaming and sparkling associated with the use of certain ignition aids and other additives may be advantageously eliminated or reduced by including such additives in the second layer of the core of the heat source while eliminating or reducing the presence of such additives in the first layer of the core of the heat source.

Alternatively, the first layer and the second layer may be transverse layers.

As used herein, the term 'transverse' is used to describe layers than meet along an interface that extends across the width of the core of the heat source.

In certain embodiments, the second layer may be downstream of the first layer.

In certain preferred embodiments, the second layer may be downstream of the first layer and the peripheral layer may circumscribe the first layer of the core. In use in smoking articles according to the invention, this allows the heat-conducting, combustion-resistant wrapper to be in direct contact with the second layer of the core of the heat source that is not circumscribed by the peripheral layer. In such embodiments, one or both of the occurrence and visibility of flaming and sparkling associated with the use of certain ignition aids and other additives may be advantageously eliminated or reduced by including such additives in the second layer of the core of the heat source circumscribed by the heat-conducting, combustion-resistant wrapper while eliminating or reducing the presence of such additives in the first layer of the core of the heat source.

Heat sources according to the invention comprise a non-combustible, thermally insulating, peripheral layer.

Preferably, the peripheral layer comprises at least about 90 percent by dry weight of thermally insulating material. For example, the peripheral layer may comprise between about 90 percent by dry weight and about 100 percent by dry weight of thermally insulating material.

The peripheral layer may be formed from one or more thermally insulating materials. Alternatively or in addition, the peripheral layer may be formed from one or more precursor materials that decompose to form one or more thermally insulating materials upon ignition of the core.

It will be appreciated that the amount of thermally insulating material that must be included in the peripheral layer of a heat source according to the invention in order to achieve a sufficient reduction in ignition propensity will vary depending on the specific thermally insulating material included in the peripheral layer.

In general, the lower the thermal diffusivity and the thermal conductivity of the thermally insulating material, the lower the amount of the thermally insulating material that must be included in the peripheral layer of a heat source according to the invention.

The peripheral layer may comprise one or more thermally insulating powder materials, one or more thermally insulating foams, one or more thermally insulating wools or a combination thereof.

Suitable thermally insulating materials for use in the peripheral layer of heat sources according to the invention are known in the art. Examples of suitable thermally insulating materials include, but are not limited to: clays such as, for example, bentonite and kaolinite; whiteware ceramics such as, for example, earthenware, porcelain, and stoneware; technical ceramics such as, for example, carbides (such as titanium carbide and zirconium carbide), nitrides (such as potassium nitride and sodium nitride), oxides (such as aluminium oxide, zirconium oxide and cerium oxide) and silicides (such as magnesium silicide and potassium silicide); minerals such as, for example, gypsum; and rocks such as, for example, igneous rocks (such as granite, obsidian, scoria and tuff); sedimentary rocks (such as chalk, claystone, diatomaceous earth and limestone) and metamorphic rocks (such as gneiss and schist).

In certain preferred embodiments, the peripheral layer comprises one or more thermally insulating materials selected from the group consisting of diatomaceous earth, gypsum and bentonite.

One or both of the peripheral layer and core of heat sources according to the invention may further comprise one or more binders.

The one or more binders may be organic binders, inorganic binders or a combination thereof.

Suitable known organic binders include but are not limited to: gums such as, for example, guar gum; modified celluloses and cellulose derivatives such as, for example, methyl cellulose, carboxymethyl cellulose, hydroxypropyl cellulose and hydroxypropyl methylcellulose; wheat flour; starches; sugars; vegetable oils; and combinations thereof.

Suitable known inorganic binders include, but are not limited to: clays such as, for example, bentonite and kaolinite; alumino-silicate derivatives such as, for example, cement, alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; and aluminium compounds and derivatives such as, for example, aluminium sulphate.

In certain embodiments, the core may be formed from a mixture comprising: carbon powder; modified cellulose, such as, for example, carboxymethyl cellulose; flour such as, for example, wheat flour; and sugar such as, for example, white crystalline sugar derived from beet.

In other embodiments, the core may be formed from a mixture comprising: carbon powder; modified cellulose, such as, for example, carboxymethyl cellulose; and optionally bentonite.

In certain embodiments, the peripheral layer may be formed from a mixture comprising: one or more thermally insulating materials; and modified cellulose, such as, for example, carboxymethyl cellulose.

To make heat sources according to the invention, the components of the non-combustible, thermally insulating, peripheral layer and the components of the combustible carbonaceous core are mixed and formed into a desired shape. The components of the peripheral layer and the components of the core may be formed into a desired shape using any suitable known ceramic forming methods such as, for example, slip casting, extrusion, injection moulding and die compaction or pressing or a combination thereof. Preferably, the components of the peripheral layer and the components of the core are formed into a desired shape by pressing or extrusion or a combination thereof.

In certain embodiments, heat sources according to the invention may be made by forming the peripheral layer and the core using a single method.

For example, heat sources according to the invention may be made by forming the peripheral layer and the core by extrusion.

Alternatively, heat sources according to the invention may be made by forming the peripheral layer and the core by pressing.

In other embodiments, heat sources according to the invention may be made by forming the peripheral layer and the core using two or more different methods.

For example, where the core of heat sources according to the invention comprises two or more transverse layers, heat sources according to the invention may be made by forming the peripheral layer and the first layer of the core by pressing and forming the second layer of the core by pressing.

Preferably, the components of the peripheral layer and the components of the core are formed into a cylindrical rod. However, it will be appreciated that the components of the peripheral layer and the components of the core may be formed into other desired shapes.

After formation, the cylindrical rod or other desired shape may be dried to reduce its moisture content.

The formed heat source is preferably not pyrolised where the core comprises at least one ignition aid selected from the group consisting of peroxides, thermites, intermetallics, magnesium, aluminium and zirconium.

In other embodiments, the formed heat source may be pyrolysed in a non-oxidizing atmosphere at a temperature sufficient to carbonise any binders, where present, and substantially eliminate any volatiles in the formed heat source. In such embodiments, the formed heat source is preferably pyrolysed in a nitrogen atmosphere at a temperature of between about 700° C. and about 900° C.

Smoking articles according to the invention comprise a heat-conducting, combustion-resistant wrapper around and in direct contact with an upstream portion of the aerosol-forming substrate and a downstream portion of the core of the heat source.

In certain embodiments, substantially the entire length of the heat source may be wrapped in the heat-conducting, combustion-resistant wrapper. In such embodiments, the heat-conducting, combustion-resistant wrapper is around and in direct contact with the peripheral layer and a downstream portion of the core of the heat source.

In preferred embodiments, an upstream portion of the heat source is not wrapped in the heat-conducting, combustion-resistant wrapper.

Preferably, the upstream portion of the heat source not wrapped in the heat-conducting, combustion-resistant wrapper is between about 4 mm and about 15 mm in length, more preferably between about 4 mm and about 8 mm in length.

Preferably, the downstream portion of the heat source wrapped in the combustion resistant wrapper is between about 2 mm and about 8 mm in length, more preferably between about 3 mm and about 5 mm in length.

In certain preferred embodiments, substantially the entire length of the peripheral layer is not wrapped in the heat-conducting, combustion-resistant wrapper.

As set out above, heat generated during combustion of the core of the heat source is transferred by conduction to the aerosol-generating substrate downstream of the heat source via the heat-conducting, combustion-resistant wrapper. This may significantly affect the temperature of the downstream portion of the core.

Heat drain exerted by the conductive heat transfer through the heat-conducting combustion-resistant wrapper may significantly lower the temperature of the downstream portion of the core wrapped in the heat-conducting combustion-resistant wrapper and keep the temperature of the downstream portion of the core significantly below its self-ignition temperature.

The heat-conducting, combustion-resistant wrapper may be an oxygen-restricting wrapper that restricts or prevents oxygen access to the downstream portion of the core wrapped in the heat-conducting, combustion-resistant wrapper. For example, the heat-conducting, combustion-resistant wrapper may be a substantially oxygen impermeable wrapper.

In such embodiments, the downstream portion of the core wrapped in the heat-conducting, combustion-resistant wrapper will substantially lack access to oxygen and so may not combust during use of the smoking article.

Preferably, the combustion-resistant wrapper is both heat-conducting and oxygen-restricting.

Suitable heat-conducting, combustion-resistant wrappers for use in smoking articles according to the invention include, but are not limited to: metal foil wrappers such as, for example, aluminium foil wrappers, steel foil wrappers, iron foil wrappers and copper foil wrappers; metal alloy foil wrappers; graphite foil wrappers; and certain ceramic fibre wrappers.

Preferably, the aerosol-forming substrate has a length of between about 5 mm and about 20 mm, more preferably of between about 8 mm and about 12 mm.

In certain embodiments, substantially the entire length of the aerosol-forming substrate may be wrapped in the heat-conducting, combustion-resistant wrapper.

In preferred embodiments, a downstream portion of the aerosol-forming substrate is not wrapped in the heat-conducting, combustion-resistant wrapper.

In certain preferred embodiments, the aerosol-forming substrate extends at least about 3 mm downstream beyond the heat-conducting, combustion-resistant wrapper.

In other preferred embodiments, the aerosol-forming substrate may extend less than 3 mm downstream beyond the heat-conducting element.

Preferably, the upstream portion of the aerosol-forming substrate wrapped in the heat-conducting, combustion-resistant wrapper is between about 2 mm and about 10 mm in length, more preferably between about 3 mm and about 8 mm in length, most preferably between about 4 mm and about 6 mm in length.

Preferably, the downstream portion of the aerosol-forming substrate not wrapped in the heat-conducting, combustion-resistant wrapper is between about 3 mm and about 10 mm in length. In other words, the aerosol-forming substrate preferably extends between about 3 mm and about 10 mm downstream beyond the heat-conducting, combustion-resistant wrapper. More preferably, the aerosol-forming substrate extends at least about 4 mm downstream beyond the heat-conducting, combustion-resistant wrapper.

Preferably, the aerosol-forming substrate comprises at least one aerosol-former and at least one material capable of emitting volatile compounds in response to heating.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

Preferably, smoking articles according to the invention comprise aerosol-forming substrates comprising nicotine. More preferably, smoking articles according to the invention comprise aerosol-forming substrates comprising tobacco.

Smoking articles according to the invention may comprise a heat source according to the invention and an aerosol-forming substrate located immediately downstream of the heat source. In such embodiments, the aerosol-forming substrate may abut the heat source.

Alternatively, smoking articles according to the invention may comprise a heat source according to the invention and an aerosol-forming substrate located downstream of the heat source, wherein the aerosol-forming substrate is spaced apart from the heat source.

Smoking articles according to the invention may comprise a non-combustible, substantially air impermeable, barrier between a downstream end of the heat source and an upstream end of the aerosol-forming substrate.

The barrier may abut one or both of the downstream end of the heat source and the upstream end of the aerosol-forming substrate.

The barrier may be adhered or otherwise affixed to one or both of the downstream end of the heat source and the upstream end of the aerosol-forming substrate.

In some embodiments, the barrier comprises a barrier coating provided on a downstream end face of the heat source. In such embodiments, preferably the barrier comprises a barrier coating provided on at least substantially the entire downstream end face of the heat source. More preferably, the barrier comprises a barrier coating provided on the entire downstream end face of the heat source.

As used herein, the term 'coating' is used to describe a layer of material that covers and is adhered to the heat source.

The barrier may advantageously limit the temperature to which the aerosol-forming substrate is exposed during ignition or combustion of the heat source, and so help to avoid or reduce thermal degradation or combustion of the aerosol-forming substrate during use of the smoking article.

Depending upon the desired characteristics and performance of the smoking article, the barrier may have a low thermal conductivity or a high thermal conductivity. In certain embodiments, the barrier may be formed of material having a bulk thermal conductivity of between about 0.1 milliwatts per metre Kelvin (W/(m·K)) and about 200 milliwatts per metre Kelvin (W/m·K) at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the heat source during ignition and combustion of the core. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

Smoking articles according to the invention may comprise blind heat sources according to the invention.

As used herein, the term 'blind' is used to describe a heat source of a smoking article according to the invention in which air drawn through the smoking article for inhalation by a user does not pass through any airflow channels along the heat source.

As used herein, the term 'airflow channel' is used to describe a channel extending along the length of a heat source through which air may be drawn downstream for inhalation by a user.

In smoking articles according to the invention comprising blind heat sources, heat transfer from the heat source to the aerosol-forming substrate occurs primarily by conduction and heating of the aerosol-forming substrate by convection is minimised or reduced. This advantageously helps to minimise or reduce the impact of a user's puffing regime on the composition of the mainstream aerosol of smoking articles according to the invention comprising blind heat sources according to the invention.

It will be appreciated that smoking articles according to the invention may comprise blind heat sources comprising one or more closed or blocked passageways through which air may not be drawn for inhalation by a user. For example, smoking articles according to the invention may comprise blind heat sources comprising one or more closed passageways that extend from an upstream end face of the heat source only part way along the length of the heat source.

In such embodiments, the inclusion of one or more closed air passageways increases the surface area of the heat source that is exposed to oxygen from the air and may advantageously facilitate ignition and sustained combustion of the core of the heat source.

In other embodiments, smoking articles according to the invention may comprise non-blind heat sources according to the invention.

As used herein, the term 'non-blind' is used to describe a heat source of a smoking article according to the invention in which air drawn through the smoking article for inhalation by a user passes through one or more airflow channels along the heat source.

In smoking articles according to the invention comprising non-blind heat sources, heating of the aerosol-forming substrate occurs by conduction and convection. In use, when a user puffs on a smoking article according to the invention comprising a non-blind heat source air is drawn downstream through the one or more airflow channels along the heat source. The drawn air passes through the aerosol-forming substrate and then downstream towards the mouth end of the smoking article.

Smoking articles according to the invention may comprise non-blind heat sources comprising one or more enclosed airflow channels along the heat source.

As used herein, the term 'enclosed' is used to describe airflow channels that are surrounded by the heat source along their length.

For example, smoking articles according to the invention may comprise non-blind heat sources comprising one or more enclosed airflow channels that extend through the interior of the core of the heat source along the entire length of the heat source.

Alternatively or in addition, smoking articles according to the invention may comprise non-blind heat sources comprising one or more non-enclosed airflow channels along the heat source.

For example, smoking articles according to the invention may comprise non-blind heat sources comprising one or more non-enclosed airflow channels that extend along the exterior of the heat source along at least a downstream portion of the length of the heat source.

In certain embodiments, smoking articles according to the invention may comprise non-blind heat sources comprising one, two or three airflow channels. In certain preferred embodiments, smoking articles according to the invention comprise non-blind heat sources comprising a single airflow channel extending through the interior of the core of the heat source. In certain particularly preferred embodiments, smoking articles according to the invention comprise non-blind heat sources comprising a single substantially central or axial airflow channel extending through the interior of the core of the heat source. In such embodiments, the diameter of the single airflow channel is preferably between about 1.5 mm and about 3 mm.

It will be appreciated that where smoking articles according to the invention comprise a barrier comprising a barrier coating provided on a downstream end face of a non-blind heat source comprising one or more airflow channels along the heat source, the barrier coating should allow air to be drawn downstream through the one or more airflow channels.

Where smoking articles according to the invention comprise non-blind heat sources, the smoking articles may further comprise a non-combustible, substantially air impermeable, barrier between the heat source and the one or more airflow channels to isolate the non-blind heat source from air drawn through the smoking article.

In some embodiments, the barrier may be adhered or otherwise affixed to the heat source.

Preferably, the barrier comprises a barrier coating provided on an inner surface of the one or more airflow channels. More preferably, the barrier comprises a barrier coating provided on at least substantially the entire inner surface of the one or more airflow channels. Most preferably, the barrier comprises a barrier coating provided on the entire inner surface of the one or more airflow channels.

Alternatively, the barrier coating may be provided by insertion of a liner into the one or more airflow channels. For example, where smoking articles according to the invention comprise non-blind heat sources comprising one or more airflow channels that extend through the interior of the core of the heat source, a non-combustible, substantially air impermeable hollow tube may be inserted into each of the one or more airflow channels.

The barrier may advantageously substantially prevent or inhibit combustion and decomposition products formed during ignition and combustion of the core of the heat source from entering air drawn downstream along the one or more airflow channels.

The barrier may also advantageously substantially prevent or inhibit activation of combustion of the core of the heat source during puffing by a user.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the heat source during ignition and combustion of the core. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where smoking articles according to the invention comprise a barrier between a downstream end of the heat source and an upstream end of the aerosol-forming substrate and a barrier between the heat source and one or more airflow channels along the heat source, the two barriers may be formed from the same or different material or materials.

Smoking articles according to the invention may comprise an airflow directing element downstream of the aerosol-forming substrate. The airflow directing element defines an airflow pathway and directs air from at least one air inlet along the airflow pathway towards the mouth end of the smoking article.

The at least one air inlet is preferably provided between a downstream end of the aerosol-forming substrate and a downstream end of the airflow directing element. The airflow pathway preferably comprises a first portion extending longitudinally upstream from the at least one air inlet towards the aerosol-forming substrate and a second portion extending longitudinally downstream from the first portion towards the mouth end of the smoking article. In use, air drawn into the smoking article through the at least one air inlet passes upstream through the first portion of the airflow pathway towards the aerosol-forming substrate and then downstream towards the mouth end of the smoking article through the second portion of the airflow pathway.

The airflow directing element may comprise an open-ended, substantially air impermeable hollow body. In such embodiments, the exterior of the open-ended, substantially air impermeable hollow body defines one of the first portion of the airflow pathway and the second portion of the airflow pathway and the interior of the open-ended, substantially air impermeable hollow body defines the other of the first portion of the airflow pathway and the second portion of the airflow pathway. Preferably, the exterior of the open-ended, substantially air impermeable hollow body defines the first portion of the airflow pathway and the interior of the open-ended, substantially air impermeable hollow body defines the second portion of the airflow pathway.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may abut the aerosol-forming substrate. Alternatively, the open-ended, substantially air impermeable hollow body may extend into the aerosol-forming substrate.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

Smoking articles according to the invention may further comprise an expansion chamber downstream of the aerosol-forming substrate and downstream of the airflow directing element, where present. The inclusion of an expansion chamber advantageously allows further cooling of the aerosol generated by heat transfer from the heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may further comprise a mouthpiece located at the mouth end of the smoking article. In such embodiments, the mouthpiece is downstream of the aerosol-forming substrate and downstream of the airflow directing element and expansion chamber, where present. Preferably, the mouthpiece is of low filtration efficiency, more preferably of very low filtration efficiency. The mouthpiece may be a single segment or single component mouthpiece. Alternatively, the mouthpiece may be a multi-segment or multi-component mouthpiece.

The mouthpiece may comprise, for example, one or more filter segments comprising cellulose acetate, paper or other suitable known filtration materials. Alternatively or in addition, the mouthpiece may comprise one or more segments comprising absorbents, adsorbents, flavourants, and other aerosol modifiers and additives or combinations thereof.

Preferably, smoking articles according to the invention comprise an outer wrapper that circumscribes at least a rear portion of the heat source, the aerosol-forming substrate and any other components of the smoking article downstream of the aerosol-forming substrate. The outer wrapper may be formed from any suitable material or combination of materials. Suitable materials are well known in the art and include, but are not limited to, cigarette paper.

If desired, ventilation may be provided at a location downstream of the heat source of smoking articles according to the invention. For example, where present, ventilation may be provided at a location along the mouthpiece of smoking articles according to the invention.

Smoking articles according to the invention may be assembled using known methods and machinery.

Features described in relation to one aspect of the invention may also be applicable to other aspects of the invention. In particular, features described in relation to heat sources according to the invention may also be applicable to smoking articles according to the invention and vice versa.

The invention will be further described, by way of example only, with reference to the accompanying drawings in which.

Figure 1:
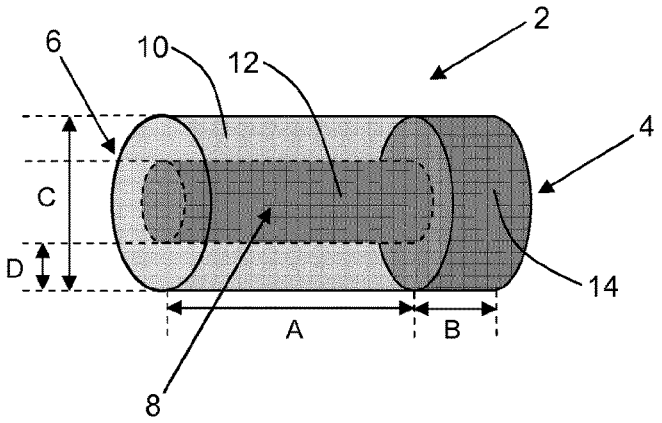
FIG. 1 shows a schematic perspective view of a heat source according to the invention.

The heat source 2 shown in FIG. 1 is a substantially cylindrical heat source having an upstream end 4 and an opposed downstream end 6 and comprising a substantially cylindrical combustible carbonaceous core 8 and an integral, non-combustible thermally insulating, annular peripheral layer 10. The core 8 extends from the upstream end 4 of the heat source 2 to the downstream end 6 of the heat source 2 and the peripheral layer 10 extends from the upstream end 4 of the heat source 2 only part way along the length of the heat source 2.

The peripheral layer 10 circumscribes an upstream portion 12 of the core 8. As shown in FIG. 1, a downstream portion 14 of the core 8 is not circumscribed by the peripheral layer 10.

The diameter of the upstream portion 12 of the core 8 is less than the diameter of the downstream portion 14 of the core 8. The difference in diameter is substantially equal to twice the thickness of the peripheral layer 10. As a result, the heat source 2 is of substantially constant diameter.

Some exemplary dimensions are provided in Table 1 for a heat source 2 according to the invention as shown in FIG. 1.

TABLE 1

| Dimension | mm |
|---|---|
| A | 9 |
| B | 4 |
| C | 7.8 |
| D | 1.3 |

In certain embodiments, the upstream portion 12 of the core 8 that is circumscribed by the peripheral layer 10 and the downstream portion 14 of the core 8 that is not circumscribed by the peripheral layer 10 may have the same composition.

In other embodiments, the upstream portion 12 of the core 8 that is circumscribed by the peripheral layer 10 may be a first layer of the core and the downstream portion 14 of the core 8 that is not circumscribed by the peripheral layer 10 may be a second layer of the core, wherein the composition of the first layer is different from the composition of the second layer.

The smoking article 22 shown in FIG. 1 comprises a heat source 2 according to the invention as shown in FIG. 1, an aerosol-forming substrate 24, an airflow directing element 26, an expansion chamber 28 and a mouthpiece 30 in abutting coaxial alignment. The heat source 2, aerosol-forming substrate 24, airflow directing element 26, expansion chamber 28 and mouthpiece 30 are overwrapped in an outer wrapper 32 of cigarette paper of low air permeability.

The aerosol-forming substrate 24 is located immediately downstream of the heat source 2 and comprises a cylindrical plug 34 of homogenised tobacco material comprising glycerine as aerosol former and circumscribed by a filter plug wrap 36.

Figure 2:
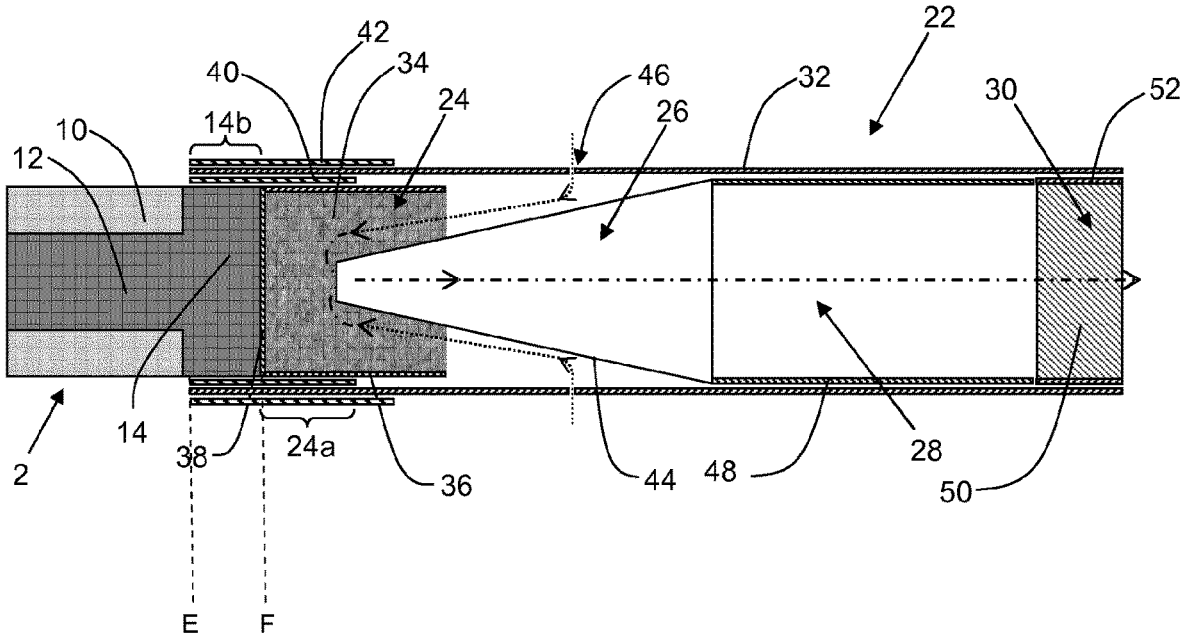
FIG. 2 shows a schematic longitudinal cross-section of a smoking article according to the invention.

A non-combustible, substantially air impermeable barrier may be provided between the downstream end of the heat source 2 and the upstream end of the aerosol-forming substrate 24. For example, as shown in FIG. 2 a non-combustible, substantially air impermeable barrier consisting of a non-combustible, substantially air impermeable, barrier coating 38 may be provided on the entire downstream end face of the heat source 2.

The smoking article 22 further comprises a heat-conducting, combustion-resistant wrapper 40 around and in direct contact with a rear portion 14*b* of the downstream portion 14 of the core 8 of the heat source 2 and an abutting front portion 24*a* of the aerosol-forming substrate 24. As shown in FIG. 2, a rear portion of the aerosol-forming substrate 24 is not circumscribed by the heat-conducting, combustion-resistant wrapper 40. The heat-conducting, combustion-resistant wrapper 40 consists of a tubular layer of aluminium foil.

An additional heat-conducting, combustion-resistant wrapper 42 also consisting of a tube of aluminium foil circumscribes and is in direct contact with the outer wrapper 32. The additional heat-conducting, combustion-resistant wrapper 42 overlies the heat-conducting, combustion-resistant wrapper 40, with the outer wrapper 32 disposed between them. The length of the additional heat-conducting, combustion-resistant wrapper 42 is greater than the length of the heat-conducting, combustion-resistant wrapper 40. The additional heat-conducting, combustion-resistant wrapper 42 therefore extends downstream beyond the heat-conducting, combustion-resistant wrapper 40 and overlies a greater length of the aerosol-forming substrate 24.

The airflow directing element 26 is located downstream of the aerosol-forming substrate 24 and comprises an open-ended, substantially air impermeable truncated hollow cone 44 made of, for example, cardboard comprises. The downstream end of the open-ended truncated hollow cone 44 is of substantially the same diameter as the aerosol-forming substrate 24 and the upstream end of the open-ended truncated hollow cone 44 is of reduced diameter compared to the aerosol-forming substrate 24.

As shown in FIG. 2, the upstream end of the open-ended, substantially air impermeable, truncated hollow cone 44 of the airflow directing element 26 extends into the aerosol-forming substrate 24. As also shown in FIG. 2, a circumferential arrangement of air inlets 46 is provided in the outer wrapper 32 circumscribing the open-ended, substantially air impermeable, truncated hollow cone 44.

The expansion chamber 28 is located downstream of the airflow directing element 26 and comprises an open-ended hollow tube 48 made of, for example, cardboard, which is of substantially the same diameter as the aerosol-forming substrate 24.

The mouthpiece 30 of the smoking article 22 is located downstream of the expansion chamber 28 and comprises a cylindrical plug 50 of cellulose acetate tow of very low filtration efficiency circumscribed by a filter plug wrap 52. The mouthpiece 30 may be circumscribed by a band of tipping paper (not shown).

An airflow pathway extends between the air inlets 46 and the mouthpiece 30 of the smoking article 22. The volume bounded by the exterior of the open-ended hollow cone 44 of the airflow directing element 26 and the outer wrapper 32 forms a first portion of the airflow pathway that extends longitudinally upstream from the air inlets 46 to the aerosol-forming substrate 24. The volume bounded by the interior of the open-ended hollow cone 44 of the airflow directing element 26 forms a second portion of the airflow pathway that extends longitudinally downstream towards the mouth piece 30 of the smoking article 22, between the aerosol-forming substrate 24 and the expansion chamber 28.

In use, when a consumer draws on the mouthpiece 30 of the smoking article 22, cool air (shown by dotted arrows in FIG. 2) is drawn into the smoking article 22 through the air inlets 46. The drawn air passes upstream to the aerosol-forming substrate 24 along the first portion of the airflow pathway between the exterior of the open-ended hollow cone 44 of the airflow directing element 26 and the outer wrapper 32.

The front portion 24*a* of the aerosol-forming substrate 24 is heated by conduction through the abutting rear portion 14*b* of the downstream portion 14 of the core 8 of the heat source 2 and the heat-conducting, combustion-resistant wrapper 40. The additional heat-conducting, combustion-resistant wrapper 42 retains heat within the smoking article 22 to help maintain the temperature of the heat-conducting, combustion-resistant wrapper 40 during smoking. This in turn helps maintain the temperature of the aerosol-forming substrate 24 to facilitate continued and enhanced aerosol delivery. In addition, the heat-conducting, combustion-resistant wrapper 42 transfers heat along the aerosol-forming substrate 24, beyond the downstream end of the heat-conducting, combustion-resistant wrapper 40. This helps to disperse heat through a larger volume of the aerosol-forming substrate 24, which in turn helps to provide a more consistent puff-by-puff aerosol delivery.

The heating of the aerosol-forming substrate 24 releases volatile and semi-volatile compounds and glycerine from the plug 36 of homogenised tobacco material, which form an aerosol that is entrained in the drawn air as it flows through the aerosol-forming substrate 24. The drawn air and entrained aerosol (shown by dashed and dotted arrows in FIG. 2) pass downstream along the second portion of the airflow pathway through the interior of the open-ended hollow cone 44 of the airflow directing element 26 to the expansion chamber 28, where they cool and condense. The cooled aerosol then passes downstream through the mouthpiece 30 of the smoking article 22 into the mouth of the consumer.

The non-combustible, substantially air impermeable, barrier coating 38 provided on the downstream end face of the heat source 2 isolates the heat source 2 from the airflow pathway through the smoking article 22 such that, in use, air drawn through the smoking article 22 along the first portion and the second portion of the airflow pathway does not directly contact the heat source 2.

The integral, non-combustible thermally insulating, annular peripheral layer 10 circumscribing the upstream portion 12 of the core 8 of the heat source 2 helps to reduce the ignition propensity of the smoking article 22 during and after use by reducing the temperature of the portion of the heat source 2 that is not circumscribed by the heat-conducting, combustion-resistant wrapper 40 and the additional heat-conducting, combustion-resistant wrapper 42.

EXAMPLES

Smoking articles according to the invention as shown in FIG. 2 having the dimensions shown in Table 2 are assembled by hand using heat sources 2 according to the invention as shown in FIG. 1 having the composition shown in Table 3 and the dimensions shown in Tables 1 and 3.

For the purposes of comparison, smoking articles of the same construction and dimensions are assembled by hand using heat sources of the same dimensions having the composition shown in Table 3.

All of the heat sources are made by manual pressing.

The ignition propensity of the smoking articles is tested using three replicates. Ten Whatman filters are placed on top of a standard filter holder and three pieces of cardboard are used to limit the perturbation of airflow.

The heat sources of the smoking articles are lit using a yellow flame lighter. The colour at the surface of the heat sources changes upon ignition due to downstream movement of a deflagration front from the upstream end to the downstream end of the heat sources. Thirty seconds after the deflagration front has reached the downstream end of the heat source, the smoking articles are placed horizontally on top of the ten Whatman filters.

The smoking articles are left on the Whatman filters until extinction or for at least 10 minutes. The Whatman filters are then removed from the filter holder and a photograph is taken of each of the ten Whatman filters.

Figure 3:
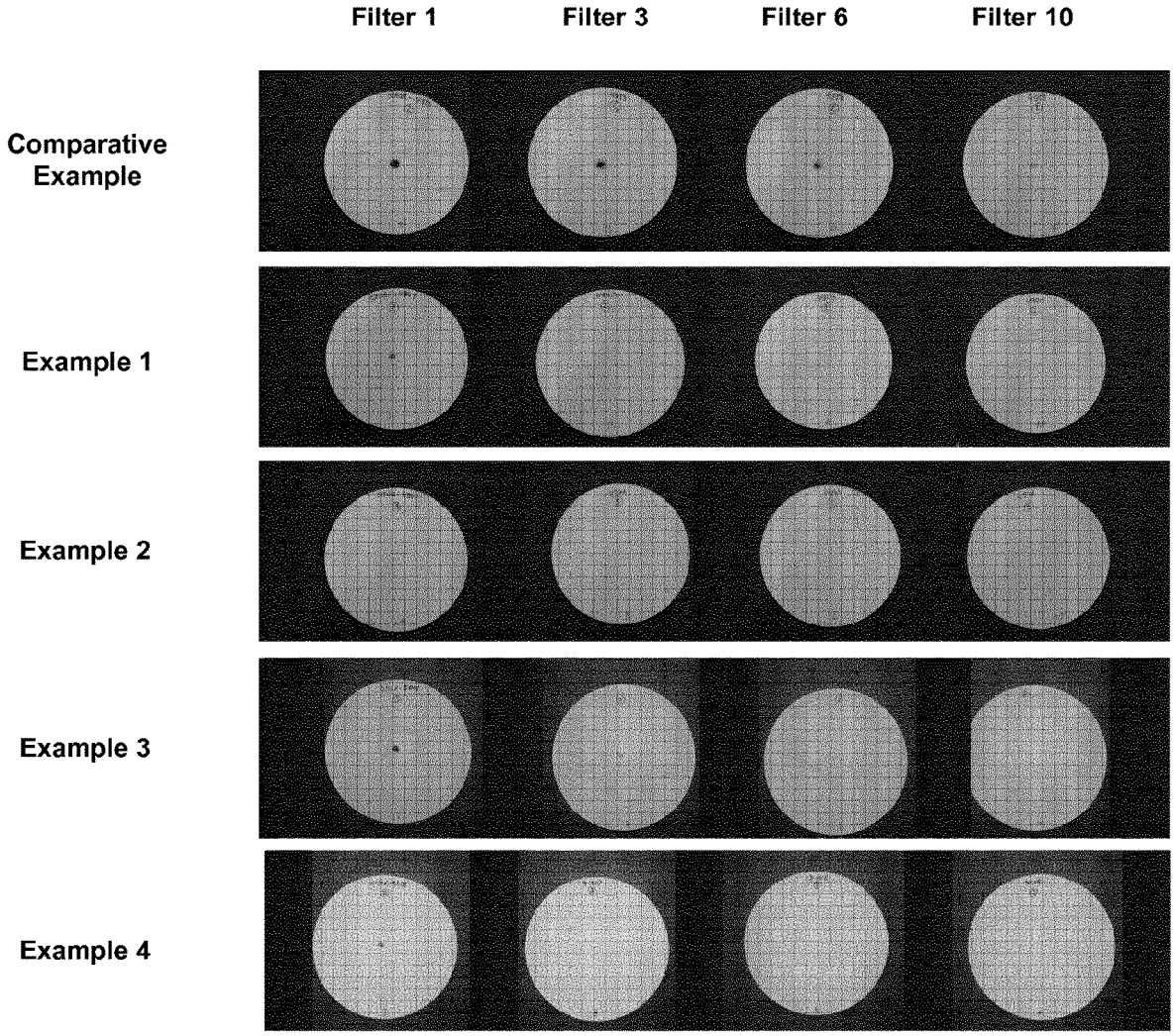
FIG. 3 shows photographs illustrating the results of ignition propensity tests conducted on three smoking articles according to the invention and a comparative smoking article described in the Examples.

The photographs of the first (uppermost), third, sixth and tenth (lowermost) Whatman filters for one representative replicate smoking article according to each example shown in Table 3 is shown in FIG. 3.

TABLE 3

| | Example 1 | Example 2 | Example 3 | Example 4 | Comparative Example |
|---|---|---|---|---|---|
| Non-combustible thermally insulating, peripheral layer | | | | | |
| Thickness (mm) | 1.3 | 1.3 | 0.8 | 0.8 | — |
| Diatomaceous earth (% by dry weight) | 95 | — | — | — | — |
| Gypsum (% by dry weight) | — | 95 | 95 | — | — |
| Bentonite (% by dry weight) | — | — | — | 95 | — |
| Carbon (% by dry weight) | — | — | — | — | 45 |
| Calcium peroxide (% by dry weight) | — | — | — | — | 50 |
| Carboxymethyl cellulose (% by dry weight) | | | 5 | | |
| Combustible Carbonaceous Core | | | | | |
| Carbon (% by dry weight) | | | 45 | | |
| Calcium peroxide (% by dry weight) | | | 50 | | |
| Carboxymethyl cellulose (% by dry weight) | | | 5 | | |

Some exemplary dimensions are provided in Table 2 for a smoking article 2 according to the invention as shown in FIG. 2 comprising a heat source 2 according to the invention as shown in FIG. 1 having the dimensions shown in Table 1.

TABLE 2

| | Distance from upstream end of heat source (mm) |
|---|---|
| E | 10 |
| F | 13 |

As shown in FIG. 3, the first, third, sixth and tenth filters for the smoking article of the comparative example are all marked. In contrast, the third, sixth and tenth filters for the smoking articles according to the invention of Examples 1, 2 and 4 are unmarked and the sixth and tenth for the smoking articles according to the invention of Example 3 are unmarked.

This demonstrates that the provision of an integral, non-combustible, thermally insulating, peripheral layer circumscribing an upstream portion of the combustible carbonaceous core of heat sources according to the invention reduces the temperature of the surface of smoking articles according to the invention and hence their ignition propensity.

The embodiments and examples described above illustrate but do not limit the invention. Other embodiments of the invention may be made and it is to be understood that the specific embodiments and examples described herein are not limiting.

The invention claimed is:

1. A smoking article, comprising:

a heat source having an upstream end and an opposed downstream end, the heat source comprising:

a combustible carbonaceous core; and an integral, non-combustible, thermally insulating, peripheral layer, wherein the core extends from the upstream end of the heat source to the downstream end of the heat source, and the peripheral layer extends from the upstream end of the heat source only part way along a length of the heat source and circumscribes an upstream portion of the core, and wherein a diameter of the heat source is substantially constant and a ratio of the diameter of the heat source to a thickness of the peripheral layer is from 10:3 to 20:1;

an aerosol-forming substrate downstream of the heat source;

a heat-conducting, combustion-resistant wrapper around and in direct contact with an upstream portion of the aerosol-forming substrate and a downstream portion of the core of the heat source;

an outer wrapper that overwraps the heat source, the aerosol-forming substrate, and the heat-conducting, combustion-resistant wrapper; and an additional heat-conducting, combustion-resistant wrapper in direct contact with the outer wrapper, wherein the additional heat-conducting, combustion-resistant wrapper overlies the heat-conducting, combustion-resistant wrapper with the outer wrapper disposed between the additional heat-conducting, combustion-resistant wrapper and the heat-conducting, combustion-resistant wrapper.

2. The smoking article according to claim 1, wherein a length of the peripheral layer is at least about 2 mm less than a length of the heat source.

3. The smoking article according to claim 1, wherein the peripheral layer comprises at least 90% by dry weight of thermally insulating material.

4. The smoking article according to claim 1, wherein the peripheral layer comprises at least one precursor material that decomposes to form at least one thermally insulating material upon ignition of the core of the heat source.

5. The smoking article according to claim 1, wherein the peripheral layer comprises at least one thermally insulating material selected from the group consisting of clays, whiteware ceramics, technical ceramics, and rocks.

6. The smoking article according to claim 1, wherein the peripheral layer comprises at least one thermally insulating material selected from the group consisting of diatomaceous earth, gypsum, and bentonite.

7. The smoking article according to claim 1, wherein the core comprises at least one ignition aid.

8. The smoking article according to claim 7, wherein the core further comprises:

a first layer comprising carbon; and a second layer comprising the at least one ignition aid, wherein a composition of the first layer is different from a composition of the second layer.

9. The smoking article according to claim 8, wherein the second layer further comprises carbon.

10. The smoking article according to claim 8, wherein the first layer further comprises the at least one ignition aid.

11. The smoking article according to claim 8, wherein the first layer comprises carbon and the at least one ignition aid, and the second layer comprises carbon and the at least one ignition aid, and wherein a ratio by dry weight of carbon to ignition aid in the first layer is different from a ratio by dry weight of carbon to ignition aid in the second layer.

12. The smoking article according to claim 8, wherein the second layer is downstream of the first layer.

13. The smoking article according to claim 12, wherein the heat-conducting, combustion-resistant wrapper is around and in direct contact with at least a downstream portion of the second layer of the core of the heat source.

14. The smoking article according to claim 2, wherein the non-combustible, thermally insulating, peripheral layer comprises thermally insulating material having a bulk thermal diffusivity of less than or equal to about 0.01 square centimetres per second ($cm^2/s$) as measured using the laser flash method.

15. The smoking article according to claim 1, wherein the heat source is a blind heat source.

16. The smoking article according to claim 1, wherein the ratio of the diameter of the heat source to the thickness of the peripheral layer is from 14:3 to 16:1.

17. The smoking article according to claim 1, wherein the thickness of the peripheral layer is between 0.5 mm and 1.5 mm.

18. The smoking article according to claim 1, wherein the peripheral layer is a single layer.

19. The smoking article according to claim 1, wherein the ratio of the diameter of the heat source to the thickness of the peripheral layer is from 5:1 to 20:1.

20. A smoking article, comprising:

a heat source having an upstream end and an opposed downstream end, the heat source comprising:

a combustible carbonaceous core; and an integral, non-combustible, thermally insulating, peripheral layer, wherein the core extends from the upstream end of the heat source to the downstream end of the heat source, and the peripheral layer extends from the upstream end of the heat source only part way along a length of the heat source and circumscribes an upstream portion of the core, and wherein a diameter of the heat source is substantially constant and a ratio of the diameter of the heat source to the thickness of the peripheral layer is from 10:1 to 20:1;

an aerosol-forming substrate downstream of the heat source; and a heat-conducting, combustion-resistant wrapper around and in direct contact with an upstream portion of the aerosol-forming substrate and a downstream portion of the core of the heat source.

21. A smoking article, comprising:

a heat source having an upstream end and an opposed downstream end, the heat source comprising:

a combustible carbonaceous core; and an integral, non-combustible, thermally insulating, peripheral layer, wherein the core extends from the upstream end of the heat source to the downstream end of the heat source, and the peripheral layer extends from the upstream end of the heat source only part way along a length of the heat source and circumscribes an upstream portion of the core, and wherein a diameter of the heat source is substantially constant and a ratio of the diameter of the heat source to a thickness of the peripheral layer is from 10:3 to 20:1 and wherein the thickness of the peripheral layer is 0.5 mm;

an aerosol-forming substrate downstream of the heat source; and a heat-conducting, combustion-resistant wrapper around and in direct contact with an upstream portion of the aerosol-forming substrate and a downstream portion of the core of the heat source.

* * * * *